United States Patent [19]

Gibbs

[11] 4,043,894

[45] Aug. 23, 1977

[54] ELECTROCHEMICAL ANODIZATION FIXTURE FOR SEMICONDUCTOR WAFERS

[75] Inventor: Stephen R. Gibbs, Escondido, Calif.

[73] Assignee: Burroughs Corporation, Detroit, Mich.

[21] Appl. No.: 688,415

[22] Filed: May 20, 1976

[51] Int. Cl.[2] ..... C25D 17/06; C25D 11/02

[52] U.S. Cl. ..... 204/297 W; 204/268

[58] Field of Search ..... 204/297 R, 297 W, 297 M, 204/268

[56] References Cited

U.S. PATENT DOCUMENTS

| | | | |
|---|---|---|---|
| 2,475,434 | 7/1949 | Moss | 204/297 W |
| 3,481,858 | 12/1969 | Fromson | 204/297 M |

*Primary Examiner*—F.C. Edmundson

*Attorney, Agent, or Firm*—G. Gregory Schivley; Mervyn L. Young; Kevin R. Peterson

[57] ABSTRACT

A fixture for holding a semiconductor wafer during anodization. The fixture has a major surface with a plurality of concentric ridges on the surface for supporting a semiconductor wafer, with adjacent ridges defining concentric channels therebetween. The fixture includes electrical contact means for contacting the inward surface of the wafer. At least one channel surrounds the contact and an insulating fluid is circulated in the channel to prevent the anodizing solution from electrically shorting to the contact. Means are also supplied for maintaining a vacuum in another channel to secure the wafer against the ridges of the fixture.

7 Claims, 3 Drawing Figures

ELECTROCHEMICAL ANODIZATION FIXTURE FOR SEMICONDUCTOR WAFERS

BACKGROUND OF THE INVENTION

This invention relates to a fixture for holding a workpiece. More particularly, it involves a fixture for holding a semiconductor wafer during anodization.

Anodization is being increasingly employed in processing semiconductor devices. For example, selective anodization is often utilized to form multilevel aluminum conductors for an integrated circuit device. One method for anodizing semiconductor wafers is to attach a clip to the edge of the substrate and immerse most of the substrate in the anodizing solution. A positive potential is applied to the clip and a negative potential to the solution by means of a noble metal electrode in the solution. However, with this method the clipped edge of the substrate must remain out of the solution and consequently is not anodized. Also, both sides of the substrate will be anodized unless the back of the substrate is protected by an insulating coating. In another method, the substrate is placed on a vacuum chuck and immersed in the anodizing solution. A metal electrode in the chuck contacts the inward side of the wafer, with another electrode contacting the solution similar to that previously described. Unfortunately, however, the vacuum tends to draw the anodizing solution around or through any imperfections in the wafer-chuck seal thereby causing a conductive path which shorts the electrodes together thereby by-passing the substrate resulting in incomplete anodization.

OBJECT AND SUMMARY OF THE INVENTION

Therefore, it is the primary object of this invention to provide an improved fixture for holding a semiconductor wafer during anodization that does not have the above-mentioned drawbacks. It is also an object of this invention to provide such an anodization fixture which can be manufactured at relatively low cost. It is another object of this invention to provide a system utilizing the fixture which can be readily removed from the anodizing bath for repair, cleaning, etc.

These and other objects of this invention are provided by a fixture having a major surface with a plurality of concentric ridges on the surface for supporting a semiconductor wafer. A plurality of concentric channels are thereby formed by adjacent ridges on the fixture surface. Means are provided for maintaining a vacuum in at least one of the channels to secure the wafer against the ridges. In such manner a plurality of closed hollow tunnels are formed by the channels and wafer surface covering them. The fixture includes electrical contact means, preferably located about the axis of the concentric ridges. The contact is surrounded by at least one channel in which an insulating fluid is circulated to prevent electrical shorting between the contact and the anodizing solution. In one embodiment, the electrical contact to the wafer is provided by a recess in the surface of the fixture which contains an electrolyte having an electrical potential applied to it. The ridges of the fixture are preferably formed by a plurality of resilient O-rings supported in corresponding grooves in the surface of the fixture. Consequently, the O-rings can be periodically replaced to insure that a good vacuum seal is maintained. In the system, the fixture is placed at the bottom of a container for holding the anodizing solution. The bottom wall of the container includes openings therein which communicate with outside sources of vacuum, insulating fluid, and electrolyte for the fixture. A plurality of threaded hollow fittings extending through the container wall engage the fixture and clamp the lower portion of the fixture to the wall of the container. In such manner, the fixture can be readily removed from the container merely by removing the fittings.

DESCRIPTION OF THE PREFERRED EMBODIMENTS

Figure 1:
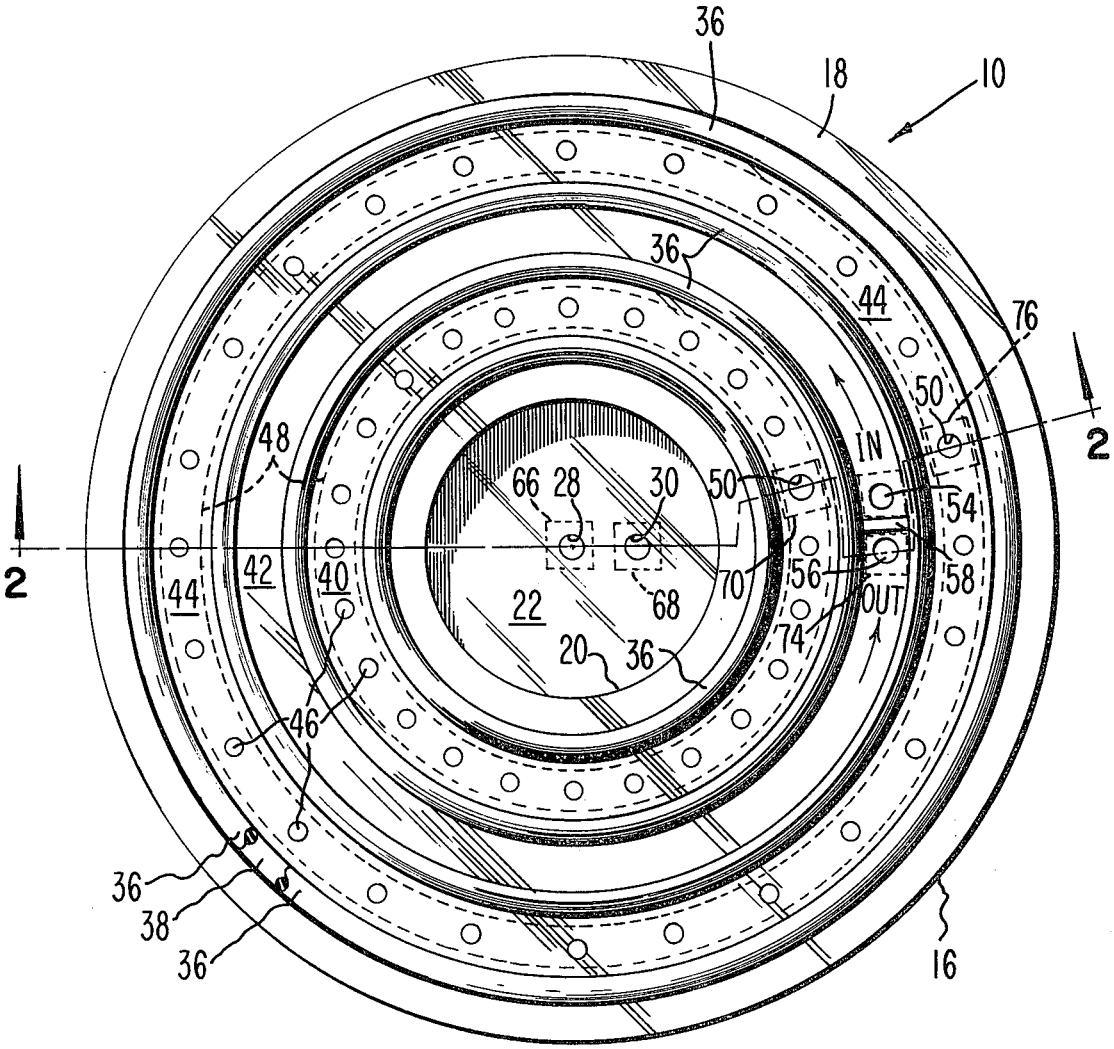
FIG. 1 is a top plan view showing one embodiment of the fixture of this invention.

Referring now to the drawings, there is shown one embodiment of the fixture of this invention which will be designated by the numeral 10. For ease of manufacture, the fixture 10 includes an upper portion 12 and a lower portion 14 which are joined at their interfacing major surfaces to form a disk 16. It will be understood that upper portion 12 and lower portion 14 are formed of an electrically insulated material such as a machinable plastic that will not be attacked by the particular electrolytes employed. Disk 16 has an upper major surface 18 having a diameter which is slightly larger than the diameter of the wafer to be processed. The upper portion 12 of disk 16 includes a centrally located aperture 20 located about the central axis of the disk 16. The upper surface of lower disk portion 14 bridges the aperture 20 to form a recess 22 in the fixture 10 which opens up to the upper surface 18. The recess 22 holds a conductive liquid or electrolyte 24 for making electrical contact with the backside of wafer 26. Opening 30 in the lower disk portion 14 provides a passageway to a source 32 of electrolyte external from fixture 10. Opening 28 provides a vent to aid in supplying the electrolyte to the recess 22 as will be later described. The electrolyte 24 can be any of a variety of conductive liquids. However, it is preferable that the electrolyte 24 be the same as the anodizing solution in which the fixture is immersed. If aluminum on the wafer is to be anodized, dilute phosphoric acid, chromic acid, oxalyic acid, sulfric acid or an ethylene glycol-ammonium pentaborate anodizing solution may be used. A positive potential is applied to the electrolyte, preferably by a noble metal electrode 34. The potential can be applied anywhere in the stream of the electrolyte 24 and, therefore, can be applied at the source 32 in order to simplify the electrical connection.

A plurality of concentric resilient rubber O-rings 36 surround the recess 22 on the upper surface 18 of the disk. In this embodiment, the O-rings lie in corresponding grooves 38 in the disk upper surface 18. O-rings 38 provide a plurality of coplanar ridges projecting from the disk upper surface 18 for receiving the wafer 26. Resilient O-rings are preferred because they provide a good seal to the wafer 26 and can be periodically replaced to insure a consistent seal. However, it is contemplated that ridges could be formed as an integral part of the disk 16 if coplanarity can be maintained. It should be noted that the ridges need not necessarily be concentric or circular as long as that they are continuous or closed-looped and that each continuous ridge has a progressively larger perimeter as they extend towards the outer periphery of the disk surface 18.

Adjacent O-rings 36 define a plurality of channels in the disk upper surface 18. In this embodiment, there are three concentric channels 40, 42 and 44 as they extend outward from recess 22. Channels 40 and 44 are vacuum channels, whereas channel 42 contains an insulating fluid as will be later described. Vacuum channels 40 and 44 each include a plurality of equally spaced openings 46 which extend through the upper disk portion 12. Openings 46 open into subjacent grooves 48 in the lower portion 14 of the disk. While the openings 46 are equally spaced in the disk upper portion 12, the grooves 48 are each continuous in the lower portion 14. Consequently, before joining the upper disk portion 12 and lower portion 14 together, the openings 46 can be drilled in the upper portion 12 and the grooves 48 can be machined into the lower portion 14. As these are relatively simple operations, the fixture can be manufactured at relatively low cost. Each groove 48 has a threaded opening 50 extending through the lower disk portion 14. Openings 50 provide a passageway for connecting with a source of vacuum 52. The vacuum source 52 thus communicates through grooves 48 and openings 46 to secure the wafer 26 against the O-rings 36.

Special consideration will now be given to channel 42 defined by the second and third O-rings 36. Channel 42 includes an inlet opening 54 and an outlet opening 56 which extend completely through disk 16 with the lower portions thereof being threaded to receive corresponding fittings. A stop member 58 extends transversely across channel 42 between inlet opening 54 and outlet opening 56. Inlet opening 54 and outlet opening 56 communicate with a source 60 of insulating fluid, such as a nitrogen gas or de-ionized water. The insulating fluid enters channel 42 via opening 54 and flows around the channel and exits through opening 56, with the stop member 58 inhibiting further flow of the fluid. The insulating fluid source 60 includes a pump 61 for recirculating the fluid.

Figure 2:
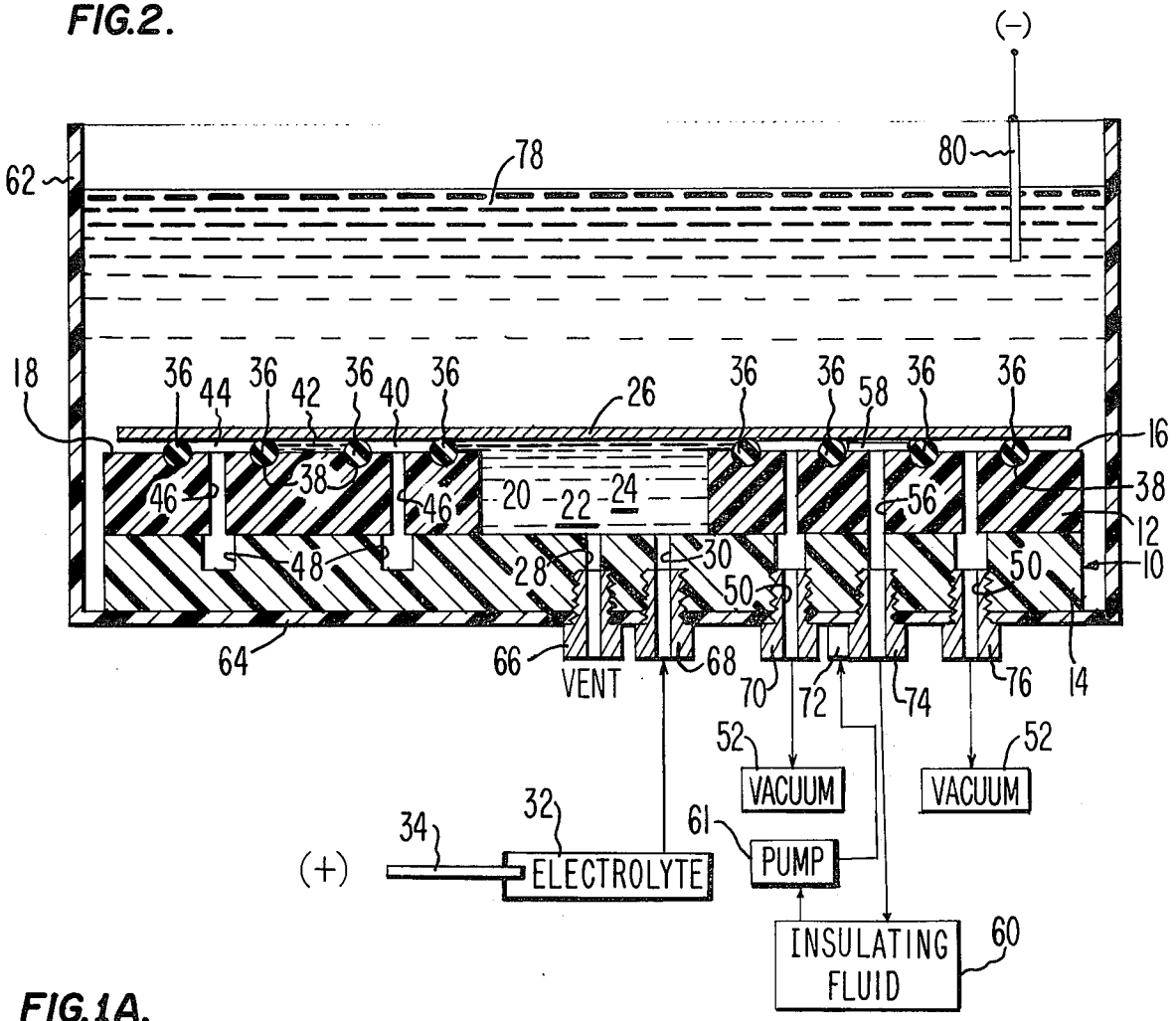
FIG. 2 is a cross sectional view of a semiconductor anodization system utilizing the fixture shown in FIG. 1 which has been cut away along the lines 2—2 therein.
Figure 1A:
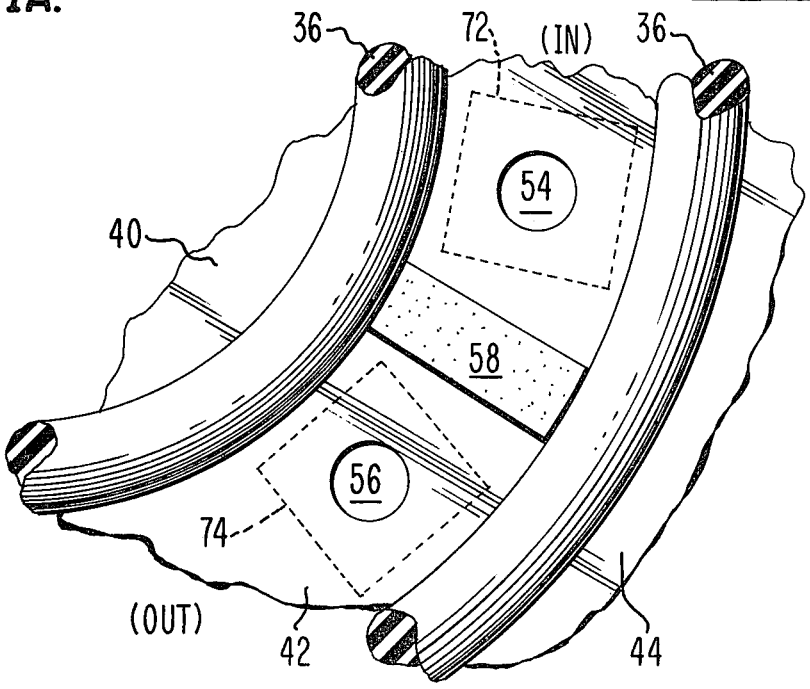
FIG. 1A is an exploded plan view of a portion of the fixture shown in FIG. 1 which illustrates the inlet and outlet for the insulating fluid channel.

Referring now especially to FIG. 2, the utilization of fixture 10 will now be illustrated in connection with an anodizing bath system. The system includes a container 62 having a bottom wall portion 64 for supporting the fixture 10. It should be noted that a plurality of fixtures can be similarly mounted in the container 62. However, this invention will be described in connection with just one fixture. The container wall 64 includes openings which correspond with the electrolyte openings (28, 30), vacuum openings (50), and insulating fluid openings (54, 56), in the lower portion of fixture 10. The fixture 10 is placed on the bottom wall 64 with the corresponding openings being aligned. Threaded hollow fittings are preferably utilized to clamp the fixture 10 against the bottom wall 64 of container 62. Fittings 66 and 68 engage the threaded portions of electrolyte openings 28 and 30, respectively. Fittings 70 and 76 engage the vacuum openings 50. Analogously, fittings 72 and 74 engage the insulating fluid inlet opening 54 and outlet opening 56, respectively.

After the fixture 10 has been mounted in the container 62, the wafer 26 is placed on the O-rings 36. Vacuum source 52 is activated to produce a vacuum in channels 40 and 44 to secure the wafer against the O-rings. The insulating fluid is then introduced into the channel 42 by source 60. The electrolyte 24 is fed into recess 22 by source 32. It should be noted that opening 28 can be used as a vent to provide the proper pressure differential to promote easy filling of the recess 22 with the electrolyte 24. The container 62 is then filled with the anodizing solution 78. A negative potential is applied via electrode 80 to the anodizing solution 78. A positive potential is applied to the wafer 26 backside via electrode 34 which contacts the electrolyte 24. Anodization of the wafer 26 then begins to occur. After the wafer has been anodized to the desired extent, the electrical potential is curtailed and the vacuum is removed so that the wafer can be lifted from the fixture 10.

It is an important feature of this invention that at least one channel, here channel 42, completely surrounds the electrical contact to the backside of the wafer. Consequently, any anodization solution 78 which may seep around the outer O-rings 36 will be neutralized and removed by the circulating insulating fluid in channel 42. In such manner the possibility of the positive electrode 34 and negative electrode 80 being shorted together by the conductive liquids is substantially reduced. Moreover, vacuum channels 40 and 44 will draw any of the anodizing solution 78 out through the lower portions of the fixture before it can short to the electrolyte 24. A fluid separating reservoir may be utilized to cooperate with vacuum source 52 to recapture the solution. It is also a feature of this invention that the entire wafer frontside is anodized with this fixture unlike the prior art fixtures where the clipped edges must remain outside of the anodizing solution and are consequently not anodized. Moreover, the wafer backside (except possibly for the extreme outer edges) is protected from unwanted anodization without the necessity of an insulating coating. It will be understood that the overall current flow is from positive electrode 34 through wafer 26 to negative electrode 80. That is to say, negative charge flow is from negative electrode 80 to wafer 26 and from wafer 26 to positive electrode 34. Therefore, no anodization or other noticable electrochemical action such as hydrogen liberation takes place on the back side of wafer 26 adjacent to recess 22 during the relatively short time the wafer is being processed. The system as shown in FIG. 2 provides the ability to easily remove the fixture 10 from the container 62 for purposes of cleaning, changing the anodizing solution, etc. All that need be done is to unscrew the threaded fittings and lift the fixture 10 from the container 62. As noted before, the O-rings 36 can be periodically replaced to insure that a good seal to the wafer is maintained.

The above mentioned description of the preferred embodiment discloses an improved anodization fixture for a semiconductor wafer. While this invention has been described in connection with a particular example thereof pursuant to the patent laws, it is contemplated that other modifications can be made to this subject matter without departing from the true scope of the invention. Consequently, the drawings are not intended to be limiting but only serve as an illustration of one embodiment. Instead, the following claims should be referred to in determining the true scope and spirit of the invention.

What is claimed is:

1. An anodization fixture for a semiconductor wafer comprising:

a body member having a major surface;

a plurality of closed looped ridges on said surface for supporting a semiconductor wafer, said ridges having a progressively larger perimeter with adjacent ridges defining channels therebetween;

electrical contact means in said body member for contacting one surface of the wafer, with at least one channel surrounding said contact;

means for maintaining a vacuum in at least one channel for securing the wafer against the ridges; and means for supplying an insulating fluid to another channel surrounding said electrical contact means to prevent electrical shorting between the contact and an anodizing solution for anodizing the wafer.

2. The fixture of claim 1 wherein the electrical contact means comprises a recess in the surface of the body member, with the recess containing an electrolyte having an electrical potential applied thereto.

3. The fixture of claim 1 wherein the ridges are comprised to concentric resilient O-rings on the surface of the body member.

4. The fixture of claim 1 which further comprises means for recirculating the insulating fluid in the channel surrounding the electrical contact means.

5. A fixture for holding a semiconductor wafer during anodization thereof, said fixture comprising:

a disk having an upper and lower portion securely fastened together, said upper portion having a centrally located aperture therein defining a recess in the disk with the lower disk portion defining the bottom therefore, at least one opening extending through said lower disk portion from the recess providing a passageway for filling the recess with an electrolyte, said upper disk portion having a major surface with a plurality of concentric resilient O-rings thereon surrounding said recess, said O-rings providing support for a semiconductor wafer and defining channels between adjacent O-rings, a plurality of openings in at least one channel extending through the upper disk portion into a subjacent groove in the lower portion, said groove in the lower disk portion having an opening extending therethrough for communicating with a source of vacuum to thereby secure the wafer against the O-rings, and at least two spaced openings extending from another channel through the disk providing an inlet and outlet to a source of recirculating insulating fluid, thereby preventing electrical shorting between the electrolyte in the recess and an anodizing solution for anodizing the wafer.

6. The fixture of claim 5 which includes a stop member projecting from the disk upper portion surface in the channel between the inlet and outlet openings for the insulating fluid.

7. A system for anodizing a semiconductor wafer comprising:

a fixture including a disk having an upper and lower portion securely fastened together, said upper portion having a centrally located aperture therein defining a recess in the disk with the lower portion defining the bottom therefore, at least one opening extending through said lower disk portion from the recess providing a passageway for filling the recess with an electrolyte, said upper disk portion having a major surface with a plurality of concentric resilient O-rings thereon surrounding said recess, said O-rings providing support for a semiconductor wafer and defining channels between adjacent O-rings, a plurality of openings in at least one channel extending through the upper disk portion into a subjacent groove in the lower portion, said groove in the lower disk portion having an opening extending therethrough for communicating with a source of vacuum to thereby secure the wafer against the O-rings, and at least two spaced openings extending from another channel through the disk providing an inlet and outlet to a source of recirculating insulating fluid, thereby preventing electrical shorting between the electrolyte in the recess and an anodizing solution for anodizing the wafer;

a container having a wall for supporting the fixture, said container wall having openings therein corresponding to the electrolyte, vacuum, and insulating fluid openings in the lower portion of the fixture; and a plurality of threaded hollow fittings extending through the container wall openings and engaging the electrolyte, vacuum, and insulating fluid openings in the fixture thereby clamping the lower portion of the fixture to the wall of the container.

* * * * *